United States Patent [19]

Lanham

[11] Patent Number: 4,981,229

[45] Date of Patent: Jan. 1, 1991

[54] INNERSEAL LINER FOR CONTAINERS

[75] Inventor: Samuel E. Lanham, New City, N.Y.

[73] Assignee: Kraft General Foods, Inc., Glenview, Ill.

[21] Appl. No.: 378,943

[22] Filed: Jul. 12, 1989

[51] Int. Cl.[5] ..... B65D 41/00

[52] U.S. Cl. ..... 215/232; 215/305; 220/270; 220/359

[58] Field of Search ..... 215/232, 305; 220/359

[56] References Cited

U.S. PATENT DOCUMENTS

| | | | |
|---|---|---|---|
| 771,960 | 6/1902 | Adams | 215/298 |
| 812,058 | 2/1906 | Mahony | 215/298 |
| 1,154,853 | 9/1915 | Freebey | 215/305 |
| 1,622,658 | 3/1927 | McBurney | 215/298 |
| 2,305,361 | 12/1942 | Tanner | 215/298 |
| 4,423,822 | 1/1984 | Powalowski | 215/305 X |
| 4,550,842 | 11/1985 | Cummings | 215/232 |
| 4,605,142 | 8/1986 | Itoh et al. | 220/359 |

FOREIGN PATENT DOCUMENTS

| | | | |
|---|---|---|---|
| 442135 | 1/1968 | Fed. Rep. of Germany . | |
| 0454556 | 7/1913 | France | 215/305 |
| 0179357 | 11/1935 | Switzerland | 215/305 |
| 0598455 | 2/1948 | United Kingdom | 215/305 |

OTHER PUBLICATIONS

"The Art and Science of Induction Sealing and Pull-Tab Lining", Journal of Packaging Technology, vol. 2, No. 3, Jun. 1988.

*Primary Examiner*—Stephen Marcus
*Assistant Examiner*—Nova Stucker
*Attorney, Agent, or Firm*—Daniel J. Donovan; Thomas R. Savoie

[57] ABSTRACT

An innerseal liner for containers is provided which permits the removal of the entire liner from the mouth of a container without any tearing of the liner. The innerseal liner is sealed to the mouth of the container and a portion of the outer circumference of the liner overhangs the outer surface of the mouth of the container. A pull tab is integrally formed with the innerseal liner and at the intersection of the pull tab with the circular portion of the liner are cut-outs in the circular periphery of the liner. The cut-outs may be arc-shaped and are of a depth approximately the same as the width of the overhang portion of the innerseal liner so that when the pull tab is pulled, the innerseal is removed from the mouth of the container along an arc approximately equal to the width of the pull tab and the length of the cut-out portions before the overhang portion of the liner is lifted from the mouth of the container.

5 Claims, 1 Drawing Sheet

INNERSEAL LINER FOR CONTAINERS

BACKGROUND OF THE INVENTION

The present invention relates to an innerseal for a container and more specifically to an innerseal which is secured to the mouth of a container and which has an integrally formed pull tab and cut-out portions in the circular periphery of the seal to ensure that the entire seal can be removed without tearing.

Small glass jars may be generally provided with a screw-type cap with an innerseal which is glued around the entire periphery of the mouth of the container. The innerseal provides an oxygen moisture barrier film and in use with certain products such as coffee also provides a vacuum seal. The inner seal is removed by pulling a pull tab which is integrally formed with the innerseal and extends from the circular periphery of the seal. However, when relatively thin laminate seals are used to seal wide mouth jars, quite frequently the seal cannot be completely removed readily because of tearing of the seal material. This tearing may be due to small nicks or cuts at the edges of the pull tab or due to damage to the corners of the tab caused by an overhang portion of the seal which extends over a portion of the outer face of the mouth of the container. Tearing may also occur due to the degree of tension in the thin laminate seal when the pull tab is grasped to remove the innerseal. While higher tension without tearing of the innerseal could be achieved by using thicker laminate seals, it is preferable to utilize seals having a thickness in the 3 to 5 mil range. Furthermore, the use of thicker laminates for the innerseal would not necessarily solve the problem of tearing of the seal due to nicks and cuts at the edges of the pull tabs.

Innerseals may be formed from a laminate of a polyester film to give the innerseal strength, a foil for moisture protection and paper or like material to provide body for the laminate. The innerseal is cut from a sheet of laminate in a two step process. The pull tab is initially cut and folded over to be within the circumference of the innerseal. The second step in the process is to simultaneously cut both the circular innerseal and a pulpboard liner. This second circular cut of the innerseal may result in nicks or cuts at the points of intersection between the pull tab and the circular portion of the innerseal. The pulpboard liner and innerseal are then forced into the container screw cap beneath a retention bead in the screw cap and simultaneously with this operation the inner liner and pulpboard liner are heated so that the wax surface of the pulpboard liner is melted and seals to the innerseal. Following this step, the upper surface of the mouth of the container is provided with glue and the screw cap is screwed tightly into engagement with the container so that the innerseal is glued to the entire upper face of the mouth of the container. Due to the pressure applied to the screw cap as it is screwed onto the container, the pulpboard liner is compressed. The innerseal has a diameter slightly larger than the outer diameter of the mouth of the container and the compression of the pulpboard causes the outer periphery of the innerseal to overhang and seal to the other surface of the mouth of the container. As the outer periphery of the innerseal is drawn downward around the outside face of the container, a cut or tear may occur between the outer edges of the pull tab and the circular periphery of the innerseal.

In use, the container cap is unscrewed to release the wax seal of the pulpboard liner from the innerseal which is glued to the mouth of the container. The pull tab on the innerseal is then grasped and pulled upwardly to release the innerseal from the mouth of the container. As noted hereinbefore, in the area between the overhang and the pull tab there is likely to be a cut or tear in the innerseal caused by the die cutting operation or due to the overhang of the circular periphery of the innerseal damaging the edges of the pull tab. Thus, when the pull tab is lifted the innerseal may be torn so that the entire innerseal is not lifted from the mouth of the container in one piece.

SUMMARY OF THE INVENTION

Tearing of the innerseal of a container during opening of the container is a particular problem with wide mouth large containers. However, by providing the inner seal with cut-out portions in the circular periphery of the seal this problem may be overcome. These cut-out portions are disposed immediately adjacent each side edge of the pull tab and are of a depth substantially the same as the width of the overhang portion of the seal. The cut-out portions may be wider than the overhang portion of the seal provided the integrity of the vacuum tight seal of the container is maintained. Preferably the cut-out portions are arc-shaped so as to avoid any sharp corners which might be likely to constitute weakened areas where tears might initiate.

The cut-out areas immediately adjacent the pull tab permits the pull tab when pulled upwardly to completely withdraw the innerseal including the overhang portion without any tearing of the innerseal. Initially, as the pull tab is drawn upwardly, the pull tab withdraws the innerseal from the top surface of the mouth of the container without having to also initially draw the overhang portion upwardly, as is the case with innerseals not having such cut-out areas. As noted hereinbefore, in such innerseals without cut-out areas there is extra tension in the pull tab as it is drawn upwardly due to the fact that the pull tab is simultaneously withdrawing both the tab from the top of the container together with the overhang outer periphery of the innerseal. The tearing of the innerseal occurs at the intersection of the pull tab and the overhang portion of the innerseal. This problem is avoided by the provision of the arc-shaped cut-out portions in the outer periphery of the innerseal adjacent the pull tab so that the overhang portion of the innerseal extends only to a point spaced from the pull tab on both sides of the tab. Thus, the tension in the innerseal necessary to both release the seal from the top face of the container and to raise the overhang portion of the seal is spread across the full width of the cut-out portions as well as across the width of the pull tab. This construction thus permits the complete removal of the innerseal without any tearing.

An object of the present invention is to provide an innerseal for a container which can be completely removed from the mouth of the container without tearing.

Another object of the present invention is to provide an innerseal for a container with a pull tab having cut-out portions adjacent the pull tab to prevent tearing of the seal when withdrawn from the container.

Other objects and many of the attendant advantages of the present invention will become more readily apparent when considered in connection with the accompanying drawings wherein:

DETAILED DESCRIPTION OF THE DRAWINGS AND PREFERRED EMBODIMENTS

Figure 1:
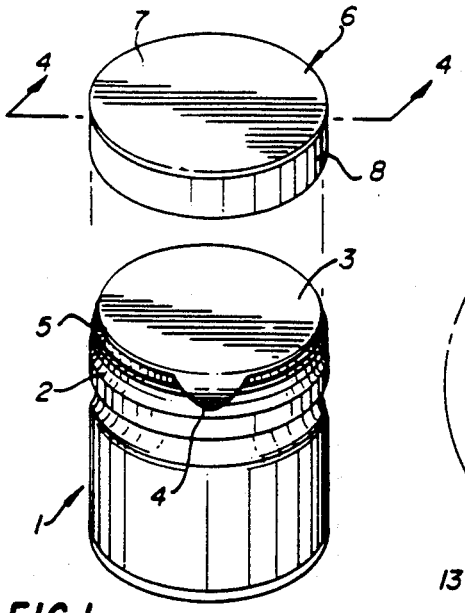
FIG. 1 is a perspective view of a small mouth container with container cap removed from the container showing an innerseal without cut-out portions in place over the mouth of the container.

Referring now more specifically to FIG. 1, there is shown a small mouth container 1 having threads 2 at the mouth of the container for receiving a screw-type cap 6. An innerseal is shown at 3, the innerseal having a pull tab 4 integrally formed therewith. The innerseal is glued to the upper face of the mouth of the container and, as shown in FIG. 1 is provided with an overhang bead 5 which extends slightly over the outer edge of the upper face of the container and downwardly around the periphery of the mouth of the container.

Figure 5:
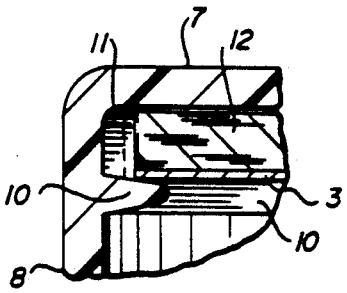
FIG. 5 is an enlarged cross section of a portion of the container cap shown in FIG. 4.
Figure 4:
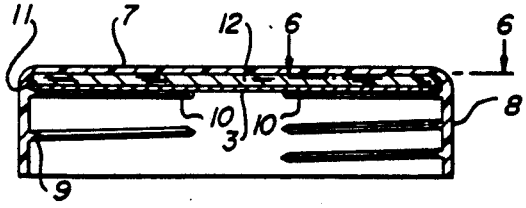
FIG. 4 is a cross-section of the container cap along the line 4—4 of FIG. 1.
Figure 6:
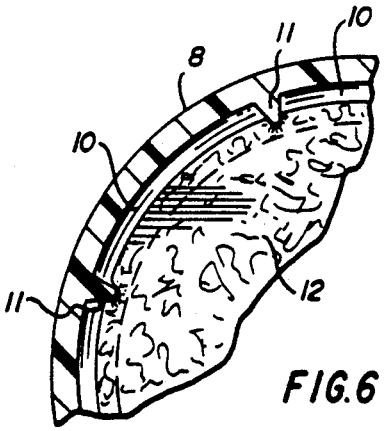
FIG. 6 is a partial sectional view of the container cap along the line 6—6 of FIG. 4.

The innerseal may be a laminate such as a Mylar to give the laminate adequate strength, a foil material to provide a moisture barrier and paper or like material for body. The laminate may be of any combination of polyester or polypropylene films with foil such that the laminate provides the appropriate oxygen and moisture barrier for the container. Preferably the innerseal laminate should have a thickness in the 3 to 5 mil range. As shown in FIG. 4, the container cap 6 comprises a topwall 7 and integrally formed circumferential sidewall 8 with internal threads 9 to engage the threads 2 on the mouth of the container 1. As shown in FIGS. 4 and 5, the cap 6 is further provided with a pair of internal ridges 10 which extend around a substantial portion of the inner face of the sidewall 8 of the cap in spaced relation to the topwall 7 of the cap. As shown in FIG. 6, a plurality of retention beads 11 are formed integrally with the sidewall 8 of the cap and are disposed between the ridges 10 and the topwall 7 of the cap and extend in perpendicular relation with respect to the ridges 10 as seen in FIG. 5.

A pulpboard liner 12 is disposed within the cap and is held in place beneath the internal ridges 10 within the cap 6 by means of the retention beads 11 which grip the outer edge of the pulpboard liner 12.

In assembly, the innerseal 3 is formed from a sheet of laminated film in a two step process. The pull tab 4 is initially cut and the pull tab is simultaneously folded over so as to be disposed within the circumference of the innerseal. A circular die then cuts the innerseal and simultaneously cuts the circular pulpboard liner 12. The innerseal and pulpboard liner are forced into the cap 6 beneath the ridges 10. The pulpboard liner has a wax coating on the surface in contact with the innerseal 3 and this wax coating is heated as the pulpboard liner and innerseal are forced into the cap so that the liner 12 and innerseal 3 are sealed together by the wax.

The container 1 is filled with product and the upper surface of the mouth of the container is covered with glue so that when the cap 6 is screwed onto the container, the innerseal is glued firmly to the upper surface of the mouth of the container. The cap is screwed down onto the container such that there is approximately 10–15% compression of the pulpboard liner 12 around the container. The compression of the pulpboard liner 12 causes the outer periphery of the innerseal to seal around the outside face of the mouth of the container as shown at 5 in FIG. 1.

When the container is to be opened, the cap 6 is unscrewed. The innerseal liner 3 is glued to the mouth of the container 1 and the pulpboard liner 12 which is wax sealed to the innerseal liner 3 is prevented from rotating due to the engagement of the pulpboard liner 12 with retention beads 11. Thus, when the cap is rotated the wax seal between the pulpboard liner and innerseal is broken so that the pulpboard liner remains in the cap when the cap is removed. The pull tab 4 may then be grasped and pulled upwardly to open the container. However, when innerseals as shown in FIG. 1 are used with wide mouth large containers, tearing of the innerseal may occur during the opening operation.

Figure 2:
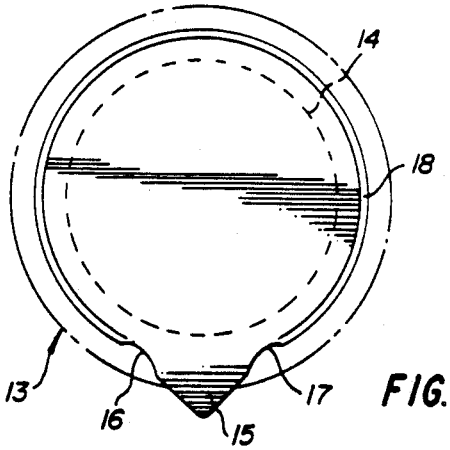
FIG. 2 is a plan view of a large mouth container with an innerseal having cut-out portions according to the present invention.
Figure 3:
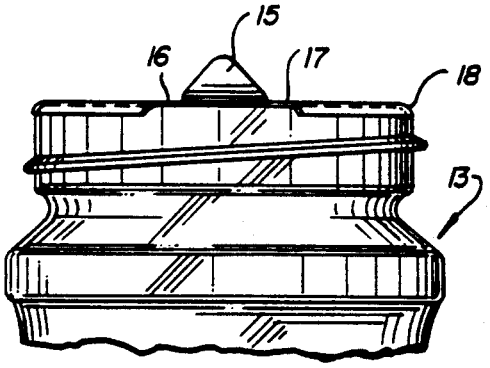
FIG. 3 is a side elevation of a container with the innerseal shown in FIG. 2 sealing the mouth of the container.

With reference to FIG. 2, there is shown a plan view of a wide mouth jar 13 with an innerseal 14 having cut-out portions to avoid tearing of the innerseal as it is removed from the container. It will be noted that adjacent the pull tab 15 of the innerseal there are provided arc-shaped cut-outs 16 and 17 which are formed in the periphery of the circular portion of the innerseal immediately adjacent each side of the pull tab 15. Referring to FIGS. 2 and 3, it can be seen that the depth of the cut-outs 16 and 17 is approximately equal to the width of the innerseal overhang 18. However, the depth of the cut-outs 16 and 17 may be greater than the width of the innerseal overhang 18 provided the integrity of the container seal is maintained. In FIG. 2 the circular dotted line represents the inner edge of the mouth of the container. It can be seen that the width of the mouth of the container is substantially greater than the innerseal overhang 18.

The innerseal 14 is secured to the mouth of the container 13 in a manner identical to that described with respect to the innerseal disclosed in FIG. 1. However, when the container cap is removed and the pull tab 15 is raised to remove the innerseal, it can be seen that initially the pull tab releases the seal from the top of the container immediately adjacent the pull tab 15 and further pulling of the tab releases the seal from the top of the container along the length of the cut-out portions 16 and 17. Thus, the cut-out portions 16 and 17 serve to decrease the amount of surface area and tension to be overcome on the initial pull. Subsequent to the release of the innerseal 14 from the mouth of the container across the full width of the pull tab 15 and the full length of the cut-out portions 16 and 17, the overhang edge portion 18 of the innerseal is raised as the innerseal is further released from the mouth of the container. By reason of the cut-outs 16 and 17 in the innerseal, a substantially increased surface area of the innerseal is tensioned when the overhang portion of the seal is withdrawn. Thus, the likelihood of tearing the innerseal during removal from the top of the container is virtually eliminated.

Obviously many modifications and variations of the present invention are possible in light of the above teachings. For example, the cut out portions may be shaped in any desired configuration, but preferably are not formed with sharp corners which could cause tearing of the innerseal. As noted hereinbefore, the innerseal can be formed from any laminate or single material having the desired moisture and air barrier properties.

What is claimed as new and is desired to be secured by Letters Patent is:

1. A cap for sealing an opening in the upper end of a container comprising a generally circular cap, a pull tab integral with said cap, a sealing area extending around the entire periphery of the generally circular cap for sealing the cap over the opening in the upper end of a container, said sealing area having a width sufficient to firmly seal the cap to a container, a generally arcuate cutout portion in the periphery of the cap immediately adjacent each side edge of the pull tab so that the width of the sealing area adjacent each side of the pull tab is reduced whereby when the cap is sealed to a container and the pull tab is pulled to release the cap from the container, the entire cap can be removed from the container without tearing of the cap.

2. A cap according to claim 1 wherein the peripheral edge of the cap forms an overhang portion around the upper end of the container.

3. A cap according to claim 2 wherein the width of the overhang portion is approximately equal to the maximum depth of the cutout portions in the periphery of the cap.

4. A sealing cap for a container comprising a cover for the mouth of the container, a sealing area extending around the entire periphery of the cap to form a seal between the cap and the horizontal surface forming the upper end of the mouth of the container, an integral pull tab extending from the cap, cutout portions in said cap on each side of said pull tab, said cutout portions in said cap reducing the width of the sealing area of the cap immediately adjacent the pull tab whereby, when said pull tab is pulled to open the container, a portion of the diameter of the cap sealed to the peripheral surface of the mouth of the container substantially greater than the width of the pull tab is released from the container before the pull tab releases the cap from the container in full width sealing areas.

5. A sealing cap for a container according to claim 4 and further including an overhang portion extending around the periphery of the cap for sealing the cap around the side surface of the mouth of the container.

* * * * *